United States Patent [19]

Oldani et al.

[11] Patent Number: 4,720,696

[45] Date of Patent: Jan. 19, 1988

[54] BIMETALLIC THERMOSTAT WITH DUAL CONTROL

[75] Inventors: Ettore Oldani; Renzo Cavinato, both of Milan, Italy

[73] Assignee: V.E.B.E. Elettromeccanica S.p.A., Milan, Italy

[21] Appl. No.: 818,116

[22] Filed: Jan. 10, 1986

[30] Foreign Application Priority Data

Feb. 4, 1985 [IT] Italy ..... 20695/85[U]

[51] Int. Cl.[4] ..... H01H 37/12; H01H 71/16

[52] U.S. Cl. ..... 337/347; 337/57; 337/368

[58] Field of Search ..... 337/368, 360, 357, 347, 337/94, 82, 57

[56] References Cited

U.S. PATENT DOCUMENTS

| | | | |
|---|---|---|---|
| 2,988,621 | 6/1961 | Cassidy | 337/347 |
| 3,004,124 | 10/1961 | Huffman | 337/347 |
| 3,226,511 | 12/1965 | Mertler | 337/347 |
| 3,423,713 | 1/1969 | Levinn | 337/368 |
| 3,568,123 | 3/1971 | Wolfe et al. | 337/346 |

FOREIGN PATENT DOCUMENTS

| | | |
|---|---|---|
| 698619 | 10/1953 | United Kingdom . |
| 1240008 | 7/1971 | United Kingdom . |
| 2054273 | 2/1981 | United Kingdom . |

*Primary Examiner*—Harold Broome
*Attorney, Agent, or Firm*—Ladas & Parry

[57] ABSTRACT

A bimetallic thermostat with dual temperature control has a first male/female screw unit, one of the elements of which is secured to the thermostat's supporting structure and the other to one of the elements of a second male/female screw unit the other element of which is operatively connected with a flexible lamina having a contact. Between the elements of at least one of the two male/female screw unit is a stop to fix the deflection of said flexible lamina affected by a bimetallic lamina of the thermostat.

1 Claim, 2 Drawing Figures

BIMETALLIC THERMOSTAT WITH DUAL CONTROL

DESCRIPTION

This invention relates to a bi-metallic thermostat with dual control.

The temperature control of heretofore known bi-metallic thermostats was limited by the sensitivity of the bi-metal temperature sensing element and said sensitivity was varied by shifting the stops associated with said bi-metal element. Consequently, it was very difficult to control, with accuracy, a temperature between the minimum and maximum limits of the bi-metal element.

The purpose of the invention is to control the temperature accurately and extend the controlled temperature range.

The thermostat according to the invention is a temperature-deflectable bi-metal lamina, at least one flexible lamina deflectable in response to the deflection of the bi-metal lamina, relevant electric contacts openable and closable in response to the deflection of the flexible lamina and adjustable means to vary the deflection of the flexible lamina. The adjustable means is characterized by a first male/female screw coupling unit, one of the elements of which is retained by the thermostat's supporting structure and the other, operatively connected with one of the elements of a second male/-female screw unit, the other element of which is operatively connected to the flexible lamina for variably deflecting the latter. Suitable stop means are interposed between the elements of both male/female screw units, to vary the temperature detected by the bi-metal lamina.

In one advantageous embodiment of the thermostat, one of the ends of the flexible lamina is secured to a supporting lamina retained by the thermostat's structure and cooperating operatively with male/female screw units located in succession with respect to each other, the last element of the succession being secured to said thermostat's supporting structure while suitable angular stops are provided in succession on each one of the moving elements of the male/female screw units.

Figure 1:
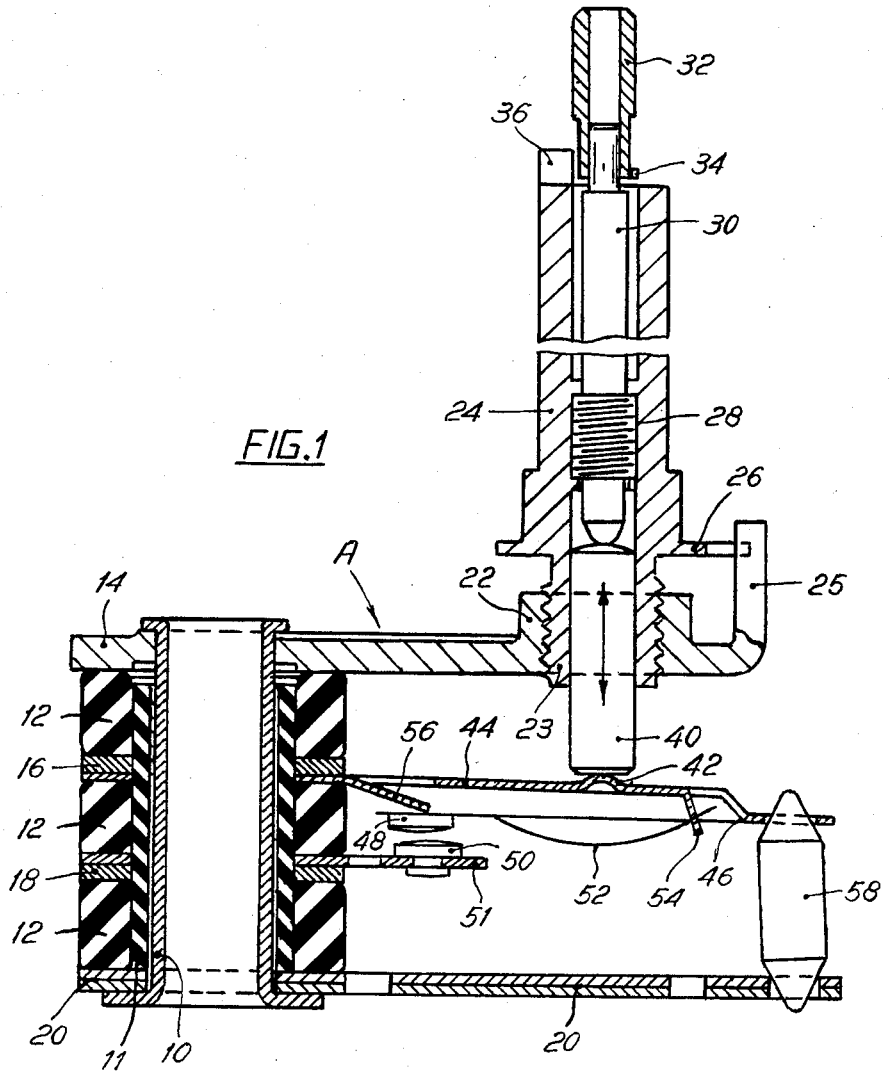
Figure 2:
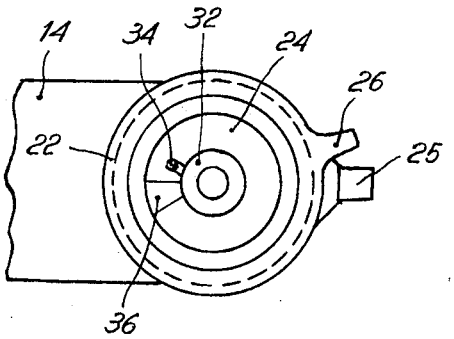

The invention will now be described, by way of example, in conjunction with the annexed drawing, in which:

FIG. 1 is an axial cross section of a preferred embodiment according to the invention FIG. 2 is a partial plan view of FIG. 1.

With reference to the figures in the drawing, letter A identifies the supporting structure of the thermostat consisting of one or more bushings 10 which are also used for fitting up the thermostat.

In particular, bushing or bushings 10 retain in succession, a insulating member 11 and insulating discs 12 which are interposed between a plate 14 of the thermostat's structure, the terminal plates 16 and 18 and the bimetallic lamina 20.

Specifically, plate 14 is provided with a threaded appendix 22, which retains a threaded end 23 of a hollow tube 24, rotatable between stops formed by a fin 25 on an end of plate 14 and by a flange 26 secured to said hollow tube 24.

The internal part of hollow tube 24 is threaded in order to be coupled to a screw or threaded part 28 of a gudgeon 30 inside said hollow tube 24. The top end of gudgeon 30 engages forcibly with a knurled button 32 to actuate screw 28. Button 32 is provided, in its lower part, with a radial projection 34, which cooperates with a fin 36 in the end of hollow tube 24 to form thereby an angular stop for screw 28# this stop can obviously be adjusted to a considerable extent by removing the button 32. Depending on end use requirements the top end of hollow tube 24 may be provided with actuating means for rotating the hollow tube to the desired extent between stops 25–26, as will be described infra.

The end of screw 28 is operatively connected (by means of a pin 40 guided by tube 24) with the convex projection 42 of a supporting metal lamina 44 connected to terminal 16. Said lamina 44 retains securely on its free end, a flexible lamina 46 terminating at its end with a contact 48 co-operating with an associated counter-contact 50 in plate 51.

Flexible lamina 46 is pre-loaded and held in the inflected condition by its mid appendix 52, engaging with fin 54 retained by supporting lamina 44. It ensues that said flexible lamina 46 is either maintained firmly in the position shown (where contact 48 is engaged with a stop 56 in supporting lamina 44) or is inflected, and engages with its associated counter contact 50.

The shifting of screws 24 and 28 causes the inflection of supporting lamina 44 consequently also of flexible lamina 46, the movement of which being controlled by a pin 58, fitted between the end of supporting lamina 44 and the bimetallic lamina 20.

The operation of the thermostat, based on the above description is quite evident. Temperature variations cause deflection of the bimetallic lamina 20, which affects the laminae 44 and 46 and, hence, the closure of contacts 48–50. The rotation of pin 30 makes possible an accurate adjustment of the supporting lamina 44 whilst the rotation of hollow tube 24 makes possible a wider movement of the same. These movements can be easily graduated by providing different pitches of the threads of parts 22–23 and 24–28. Preferably, parts 24–28 may have threads of a smaller pitch with respect to that of parts 22–23.

The control of temperature with the thermostat above described may be achieved either by varying the length of pin 58 (or of stop 56) or by adjusting male/-female screw units 22–23 or 24–28, the latter being used, practically, to control the operating temperature of the device to be controlled.

What is claimed is:

1. A bi-metallic thermostat, comprising:

a supporting structure;

a bi-metal lamina projecting from the supporting structure for deflection in response to temperature changes;

at least one flexible-lamina means projecting from the supporting structure for deflection in response to the deflection of the bi-metal lamina;

contact means on the supporting structure for opening and closing contact in response to the deflection of the flexible-lamina means;

a first male/female coupling having a male and a female element for screw cooperation upon relative rotation, one of the elements being retained on the supporting structure; and a second male/female coupling having a male and a female element for screw cooperation upon relative rotation, one of the elements of the second male/female coupling being operatively connected with the other element of the first male/female coupling, and the other element of the second male/female coupling being operatively connected to the flexible lamina for variably deflecting the latter, one of the elements of the second male/-female element projecting from the first male/-female coupling for the relative rotation thereof independently of the latter; and stop means on both of the first and second male/-female couplings for respectively limiting the relative rotation of the elements thereof.

* * * * *